US010323903B2

(12) United States Patent
Hedeen et al.

(10) Patent No.: US 10,323,903 B2
(45) **Date of Patent: *Jun. 18, 2019**

(54) AUTO ON GUN ACCESSORY

(71) Applicant: Laser Aiming Systems Corporation, Maple Plain, MN (US)

(72) Inventors: Brian Hedeen, Orono, MN (US); Tom Otteson, Burnsville, MN (US)

(73) Assignee: Laser Aiming Systems Corporation, Maple Plain, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/044,301

(22) Filed: Jul. 24, 2018

(65) Prior Publication Data

US 2018/0321015 A1 Nov. 8, 2018

Related U.S. Application Data

(63) Continuation of application No. 15/600,596, filed on May 19, 2017, now Pat. No. 10,060,701, which is a continuation of application No. 13/720,083, filed on Dec. 19, 2012, now Pat. No. 9,658,031.

(60) Provisional application No. 61/577,433, filed on Dec. 19, 2011.

(51) Int. Cl.
*F41G 1/35* (2006.01)
*F41C 33/02* (2006.01)

(52) U.S. Cl.
CPC ..... *F41G 1/35* (2013.01); *F41C 33/0254* (2013.01); *F41C 33/0263* (2013.01)

(58) Field of Classification Search
CPC ..... F41G 1/35; F41G 1/32; F41G 1/34; F41G 1/345; F41G 1/36; F41C 33/02; F41C 33/02554
See application file for complete search history.

(56) References Cited

U.S. PATENT DOCUMENTS

| | | | | |
|---|---|---|---|---|
| 8,510,979 | B1 * | 8/2013 | Mortimer | F41G 1/35 42/1.08 |
| 9,658,031 | B1 * | 5/2017 | Hedeen | F41G 1/35 |
| 10,060,701 | B1 * | 8/2018 | Hedeen | F41G 1/35 |
| 2011/0047851 | A1 * | 3/2011 | Mock | F41C 23/16 42/72 |
| 2015/0184978 | A1 * | 7/2015 | Hedeen | F41G 1/35 42/114 |

* cited by examiner

*Primary Examiner* — Stephen Johnson
(74) *Attorney, Agent, or Firm* — Faegre Baker Daniels LLP

(57) ABSTRACT

An electronic accessory for a firearm includes a housing including a right side, a left side, and an attachment mechanism for securing the electronic accessory to the firearm. The housing contains components of the electronic accessory. The components of the electronic accessory include an electronic component, a sensor sensing a magnetic field, and a circuit board coupled to the electronic component and the sensor. The circuit board controls the electronic component and suspends power to the electronic component when the sensor senses a magnetic field above a threshold strength. A first switch is disposed on the right side of the housing and a second switch is disposed on the left side of the housing. The switches are operable to control the electronic component via the circuit board. A power source provides power to at least one of the electronic component, the sensor, and the circuit board.

13 Claims, 22 Drawing Sheets

AUTO ON GUN ACCESSORY

RELATED APPLICATIONS

This application is a continuation application of U.S. patent application Ser. No. 15/600,596, entitled AUTO ON GUN ACCESSORY, filed on May 19, 2017, now U.S. Pat. No. 10,060,701, which is a continuation application of U.S. patent application Ser. No. 13/720,083, entitled AUTO ON GREEN LASER SIGHT, filed on Dec. 19, 2012, now U.S. Pat. No. 9,658,031, which claims the benefit of U.S. Provisional Application Ser. No. 61/577,433, entitled AUTO ON GREEN LASER SIGHT, filed Dec. 19, 2011, which applications are incorporated by reference herein in their entireties.

TECHNICAL FIELD

The present invention relates to accessories used with firearms, and more particularly to laser sighting devices and other accessories designed for removable attachment to a barrel of a handgun.

BACKGROUND

A wide variety of accessories have been developed for users of firearms, to facilitate target visualization and improve targeting accuracy. Among these are laser sighting devices configured to generate a coherent energy beam parallel or nearly parallel to the extension of a gun barrel, with the precise alignment depending largely on the distance to the target and windage. When activated, the coherent energy beam forms a spot of light on the target, to indicate the expected point of impact of the firearm projectile. These devices can enhance the experience of any firearm user, and have considerable importance in certain law enforcement and military operations.

Typical laser sighting devices employ visible red or infrared laser frequencies, as energy at the desired frequency can be generated directly, e.g. with a neodymium-doped yttrium aluminum garnet (Nd:YAG) crystal. More recently, it has been discovered that visible light in the "green" range, e.g. having a wavelength in the 490-570 nanometer range, has much higher visibility than visible red laser energy. The more visible beam, while enhancing utility of a sighting device in general, is particularly effective for daytime use.

A difficulty that has limited the use of green laser energy in sighting devices is the need for additional components not required by visible red and infrared lasers. To generate coherent energy in the green region of the spectrum, an Nd:YAG crystal is used to generate energy at a wavelength outside the visible spectrum, e.g. 1064 nm, that is then provided to a frequency doubler, e.g. a potassium titanium oxide phosphate (KTP) or lithium triborate (LBO) crystal to generate the desired wavelength, in this case 532 nm. The additional components require a larger laser drive circuit, typically a printed circuit board, and a larger power supply to meet a higher power requirement. The resulting sighting device is larger and difficult to use with handguns, either because the handgun barrel is not long enough to accommodate the device, or because the device protrudes ahead of the barrel an excessive amount. In accessory devices incorporating green laser sighting and white light (multichromatic energy) illumination, this difficulty is magnified.

Another problem encountered with the green laser is the higher power requirement and the accompanying reduction in useful life of the power source, typically one or more batteries. A larger battery of course contributes to the size of the device; all the more so in devices that combine laser and multichromatic illumination as they typically employ separate voltage level power sources for the separate light sources.

While sighting devices and other accessories can be mounted to firearms in a variety of ways, one approach gaining increasing acceptance involves forming longitudinally extending rails on opposite sides below the barrel of a handgun ahead of the trigger guard, for example as shown in U.S. Pat. No. 6,185,854 (Solinsky et al.). The accessory or auxiliary device is provided with opposed projections, each slidable relative to one of the rails to guide the accessory for longitudinal travel relative to the barrel. The accessory also carries a transverse spring loaded bar that fits into a transverse groove formed in the barrel to secure the accessory against longitudinal travel. While this approach has proven useful for attaching a variety of accessories including laser sights and illumination devices, problems are encountered due to the differences in locations for the transverse grooves among different brands of firearms.

SUMMARY

The disclosure pertains generally to laser sighting devices such as green laser gun sights that are configured to be easily attached to a variety of different hand guns. In some embodiments, the laser gun sights are configured to permit elevation and windage adjustment without requiring movement of an entire laser module, thereby affording use of a more compact device housing. In some embodiments, the laser gun sights are configured such that the gun sight shuts off when a gun equipped with the laser gun sight is holstered, and turns itself back on when the gun is drawn from the holster.

While multiple embodiments are disclosed, still other embodiments will become apparent to those skilled in the art from the following detailed description, which shows and describes illustrative embodiments. Accordingly, the drawings and detailed description are to be regarded as illustrative in nature and not restrictive.

Figure 1:
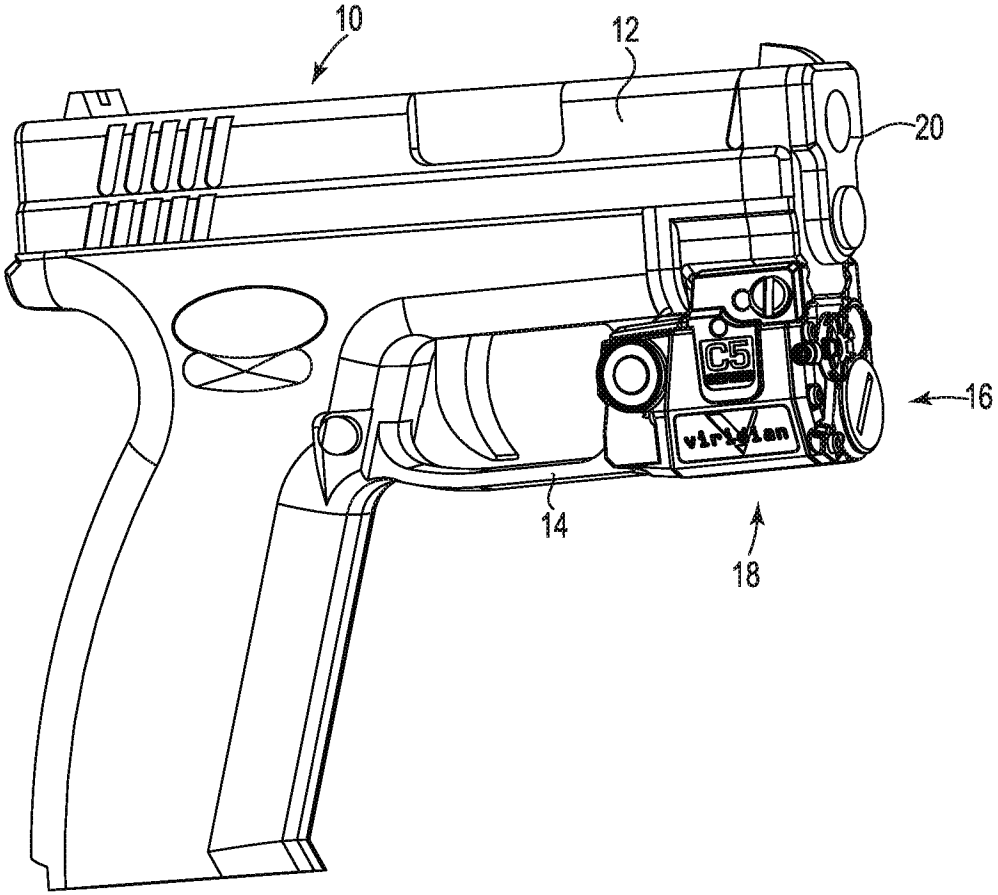
FIG. 1 is a perspective view of an illustrative green laser gun sight secured to a handgun in accordance with an embodiment of the present invention.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives thereof.

DETAILED DESCRIPTION

The disclosure pertains generally to laser gun sights such as green laser gun sights that are configured to be easily attached to a variety of different hand guns. In some embodiments, the green laser gun sights are configured to permit elevation and windage adjustment without requiring movement of an entire laser module, thereby affording use of a more compact device housing. In some embodiments, the laser module can be in direct contact with the housing. Because the housing can then function as a heat sink, a smaller laser module may be used.

Figure 8:
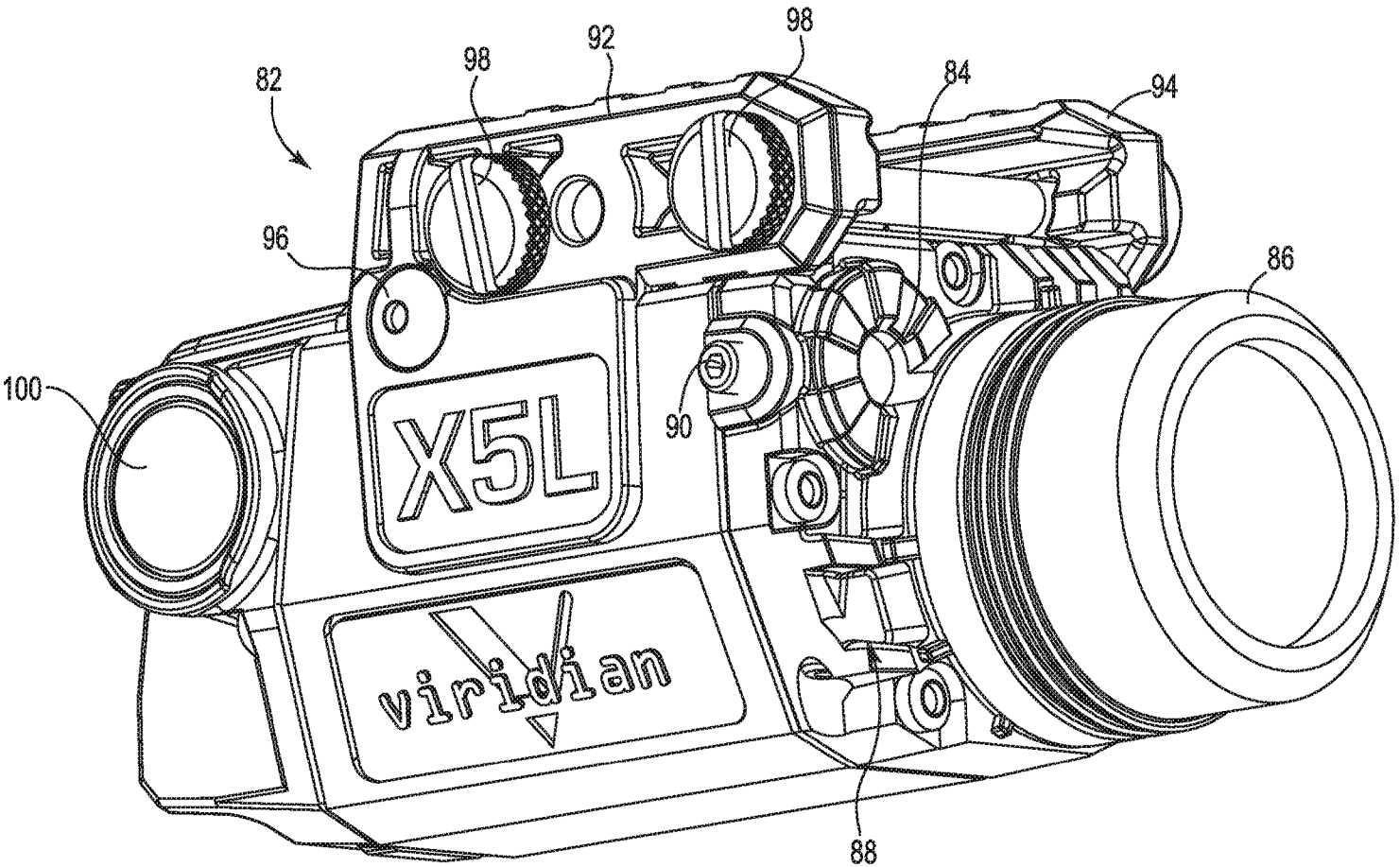
FIG. 8 is a front perspective view of an illustrative green laser gun sight in accordance with an embodiment of the present invention.
Figure 9:
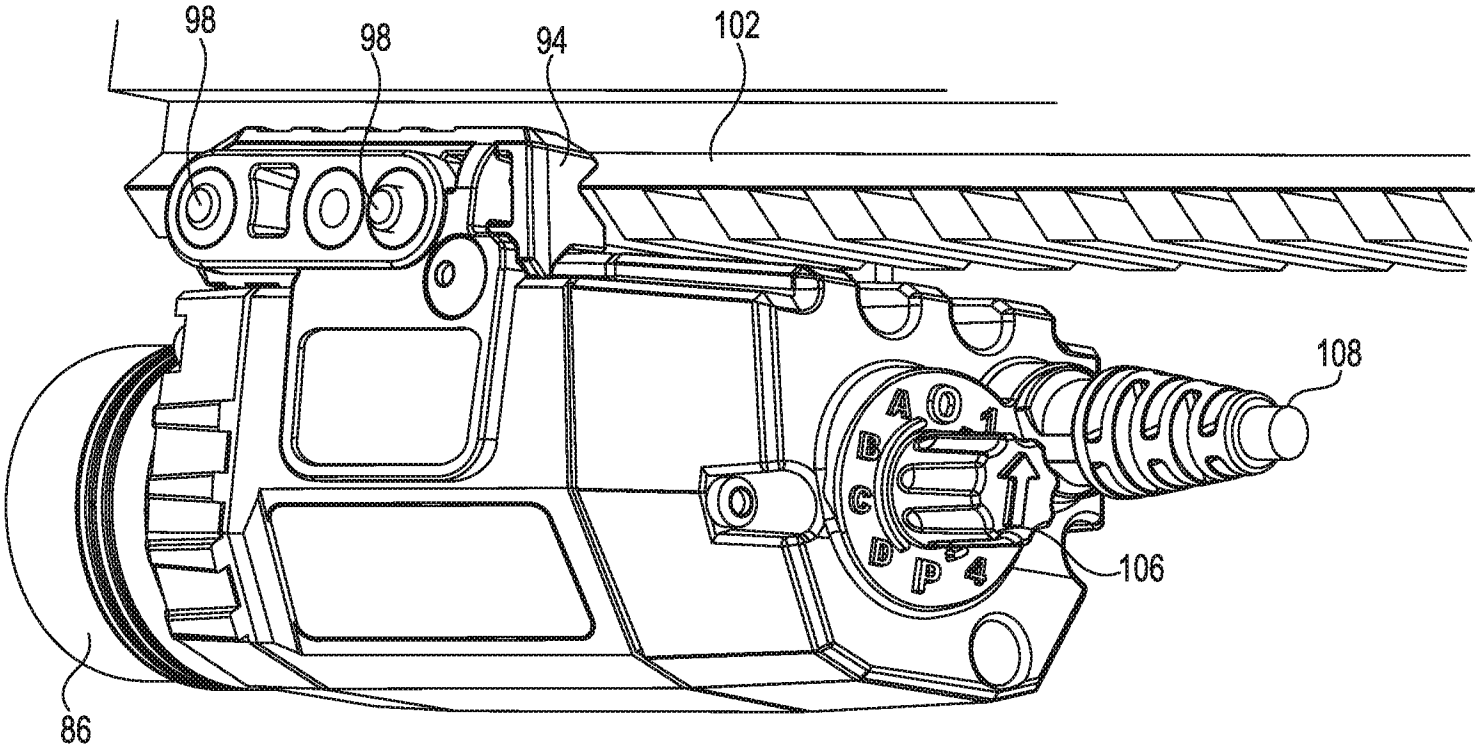
FIG. 9 is a rear perspective view of the green laser gun sight of FIG. 8, shown mounted on a gun having a long rail system.
Figure 10:
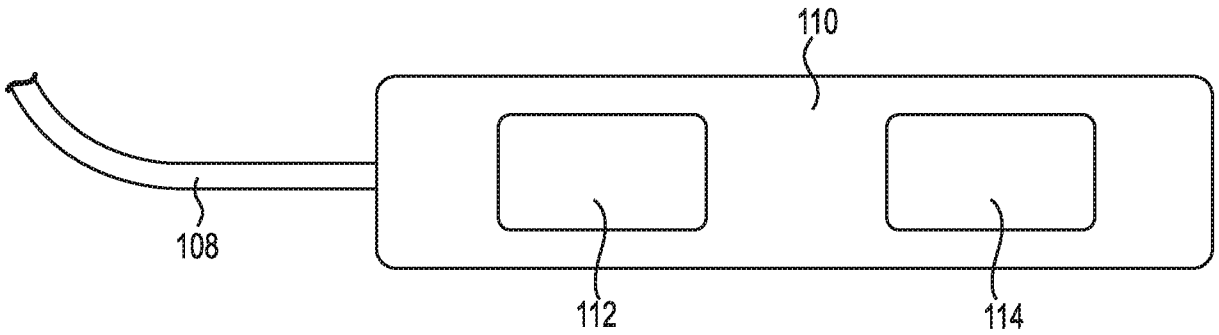
FIG. 10 is a schematic illustration of a remote switch that may be used with the green laser gun sight of FIG. 8.

The green laser gun sights described herein may be used with a variety of different gun styles and sizes, including handguns, rifles, shotguns and the like. For purposes of illustration, FIGS. 1 through 7 illustrate an embodiment of a green laser gun sight attached to a small handgun while FIGS. 8 through 10 illustrate an embodiment of a green laser gun sight secured to a larger gun such as a rifle. FIGS. 11 through 14 illustrate an embodiment of a holster that is configured to be used in combination with a handgun to which a green laser gun sight has been attached. Embodiments of the holster are configured to engage various portions of the green laser gun sight to releasably secure the gun within the holster without engaging the trigger guard. In some embodiments, the green laser gun sight and the holster are configured, in combination, to automatically shut off the green laser gun sight when a gun is holstered and to automatically turn on the green laser gun sight when the holstered gun is drawn, or removed from the holster.

Turning to FIG. 1, a handgun 10 is illustrated. The handgun 10 includes, among other elements and features, a barrel 12 and a trigger guard 14. The barrel 12 includes a rail system 16 that is configured to accommodate a variety of different accessories and other attachments. In some embodiments, a laser gun sight 18 may be attached. In some embodiments, as illustrated, the green laser gun sight 18 is secured to the rail system 16 ahead of the trigger guard 14. In some embodiments, the green laser gun sight 18 is configured such that the green laser gun sight 18 does not extend beyond a muzzle end 20 of the barrel 12. It will be appreciated that the rail system 16 may vary somewhat, depending on the identity of the handgun 10. Further details of the green laser gun sight 18, as well as details of how the green laser gun sight 18 attaches to the handgun 10, will be discussed with respect to subsequent Figures.

Figure 2A:
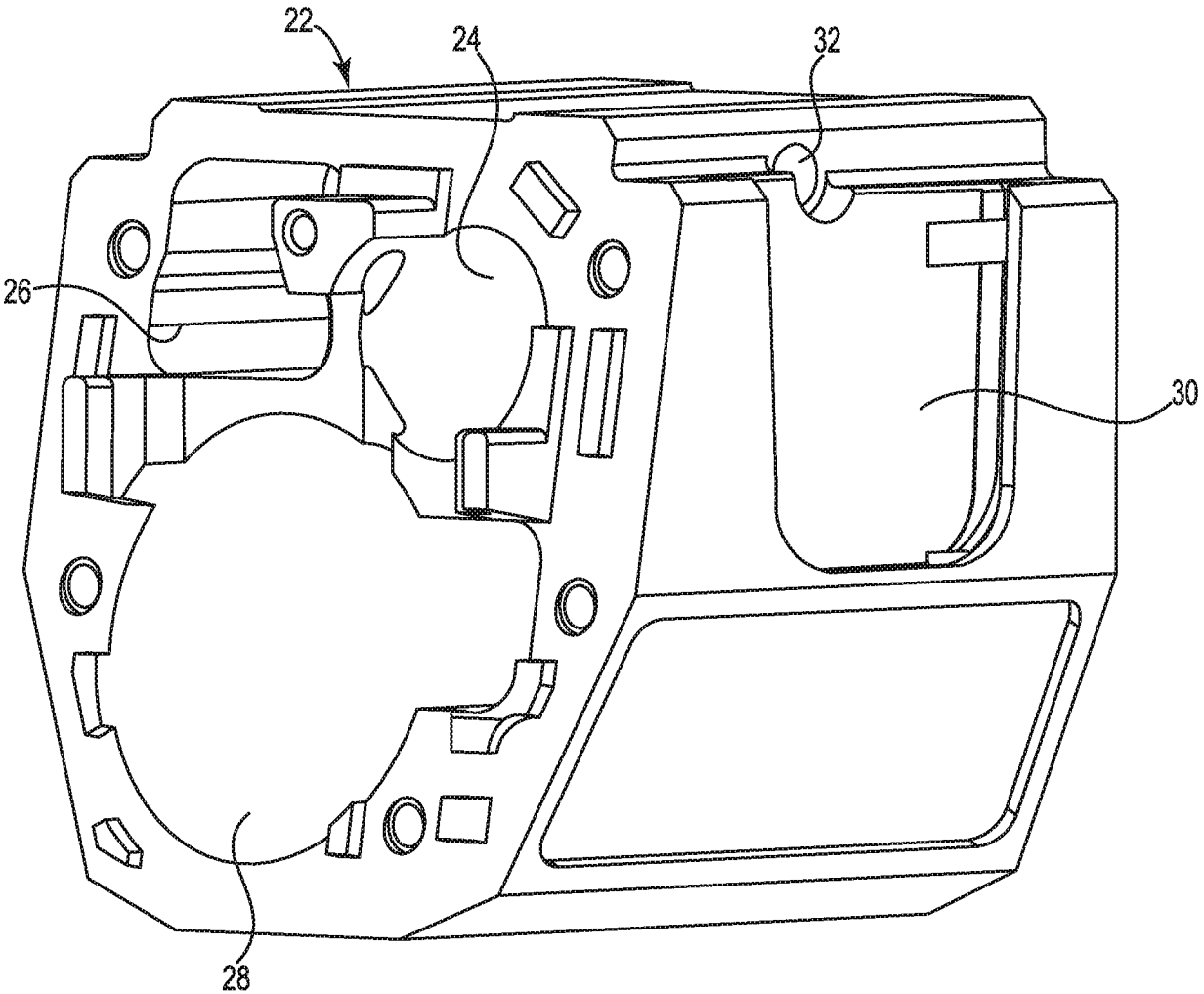
FIGS. 2A and 2B are perspective views of a housing forming a portion of the green laser gun sight of FIG. 1.
Figure 2B:
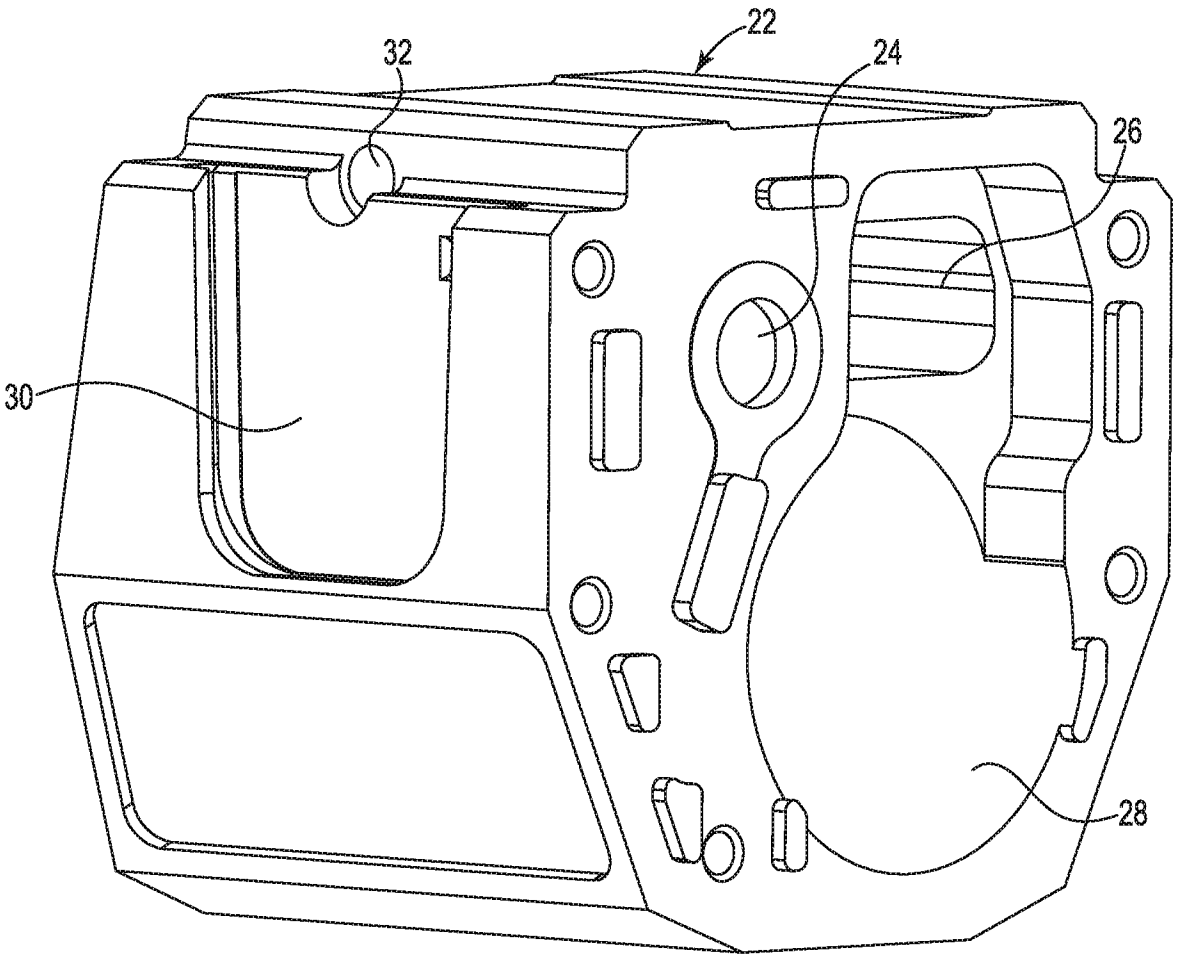

FIGS. 2A and 2B are perspective views of a housing 22 that forms a part of the green laser gun sight 18. FIG. 2A is a right rear perspective view while FIG. 2B is a left front perspective view. The housing 22 may be formed of any suitable material. In some embodiments, the housing 22 is formed of a strong, lightweight metal such as aluminum. It will be appreciated that the housing 22, particularly if formed of a highly heat conductive material such as aluminum, will function as a heat sink. The housing 22 includes several apertures such as a green laser module aperture 24, a visible light module aperture 26 and a larger aperture 28 that may be configured to accommodate a battery (not illustrated) as well as at least some of the laser circuitry. In some embodiments, the visible light module may include an LED light source.

The housing 22 also includes features that facilitate attachment of the green laser gun sight 18 to the handgun 10. A pair of grooves 30 are formed, one on each side of the housing 22 (only one visible in this illustration). As will be explained subsequently, the grooves 30 accommodate a rail set that connects the green laser gun sight 18 to the handgun 10. The housing 22 also includes a through aperture 32 that also helps to connect the green laser gun sight 18 to the handgun 10.

Figure 3:
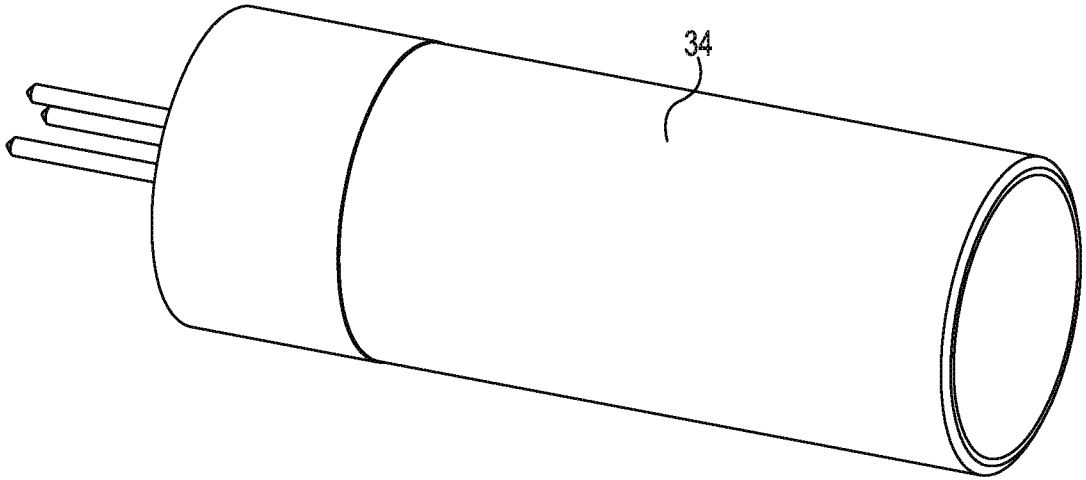
FIG. 3 is a perspective view of a green laser module.

FIG. 3 is a perspective view illustrating a green laser module 34 that is aligned to slide into the laser module aperture 24. In some embodiments, the green laser module 34 has a cylindrical shape that fits snugly into the laser module aperture 24. As a result, the housing 22 may serve as a heat sink for the green laser module 34. This may be especially beneficial, as green lasers tend to produce more heat than a correspondingly-powered red laser.

Figure 4:
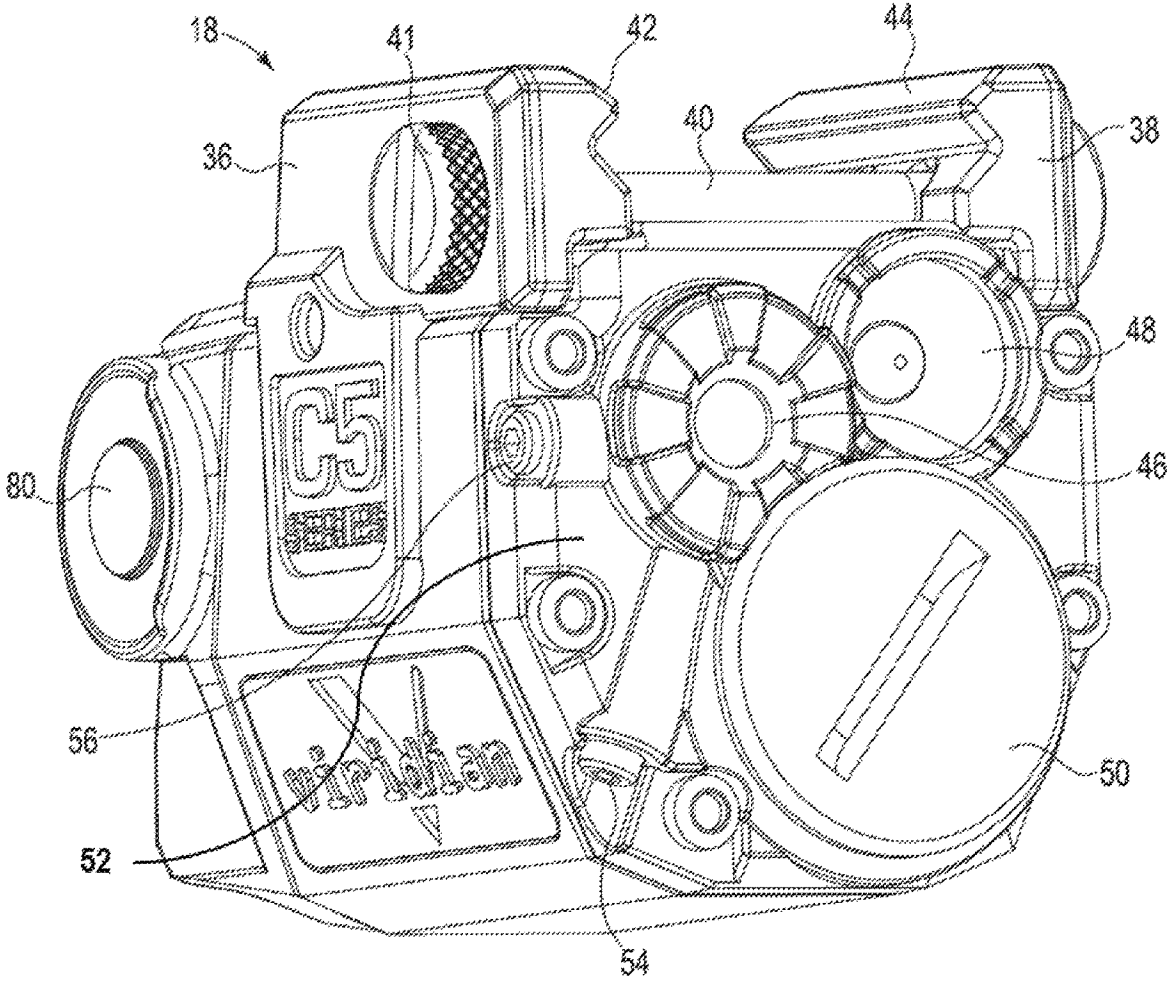
FIG. 4 is a perspective view of the green laser gun sight of FIG. 1.

FIG. 4 is a front perspective view of the green laser gun sight 18. Rail sets 36 and 38 are disposed on either side, respectively, of the green laser gun sight 18 and fit into the grooves 30 disposed on either side of the green laser gun sight 18. It will be appreciated that the rail sets 36 and 38 slide downward into the grooves 30. A cross pin 40 extends between the rail sets 36 and 38 and secures the rail sets 36 and 38. In some embodiments, for example, the cross pin 40 may slide through an aperture formed in the rail set 36 and may be threadedly engaged in a corresponding threaded aperture formed within the rail set 38. The cross pin 40 may be considered as including a head 41 that may be used in advancing or withdrawing the cross pin 40 as well as a threaded portion 43 (shown in FIG. 7). As will be discussed, the head 41 may also be used to help secure the green laser gun sight 18 (and hence the handgun 1) within a holster.

As will be illustrated with respect to a subsequent drawing, the cross pin 40 also helps to secure the rail sets 36 and 38, and hence the green laser gun sight 18, to the handgun 10. It can be seen that the rail set 36 includes a mounting surface 42 and the rail set 38 includes a mounting surface 44. The mounting surfaces 42 and 44 may be configured to interact with the rail system (FIG. 1) and may be modified to fit a particular handgun 10.

The green laser gun sight 18 includes a front cover 52 that in some embodiments may be formed of a suitable polymeric material. The front cover 52 includes a portion 46 that is configured to permit laser light to emerge as well as a portion 48 that is configured to accommodate a visible light. A cover 50 seals off the larger aperture 28 (FIG. 2). In some embodiments, the cover 50 may be threadedly engaged with the housing 22, but this is not required. An elevation screw 54 and a windage screw 56 are arranged along one side of the portion 46.

In some embodiments, the green laser gun sight 18 includes one or more switches 80 that can be used, for example, to program the green laser gun sight 18, to turn the green laser module 34 on or off, to turn the visible light module on or off, or to vary a pulse rate for the green laser module 34 and/or vary a strobe rate for the visible light module. In some embodiments, there are a pair of switches 80, with one switch 80 arranged on each side of the green laser gun sight 18. In some embodiments, as will be discussed subsequently, the switch(es) 80 may be disposed at a remote location.

In some embodiments, the switch 80 on the right side of the green laser gun sight 18 and the switch 80 on the left side of the green laser gun sight 18 may be used interchangeably. For example, it may be more natural for a right-handed user to use their thumb to operate the switch 80 on the left side of the green laser gun sight 18 while a left-handed user may use their thumb to operate the switch 80 on the right side of the green laser gun sight 18. In some cases, a user may prefer to turn the green laser gun sight 18 on or off using a different finger, before they are holding the gun 10 in a ready-to-fire position. In some embodiments, the green laser gun sight 18 includes circuitry that enables either switch 80 to be used.

Figure 5:
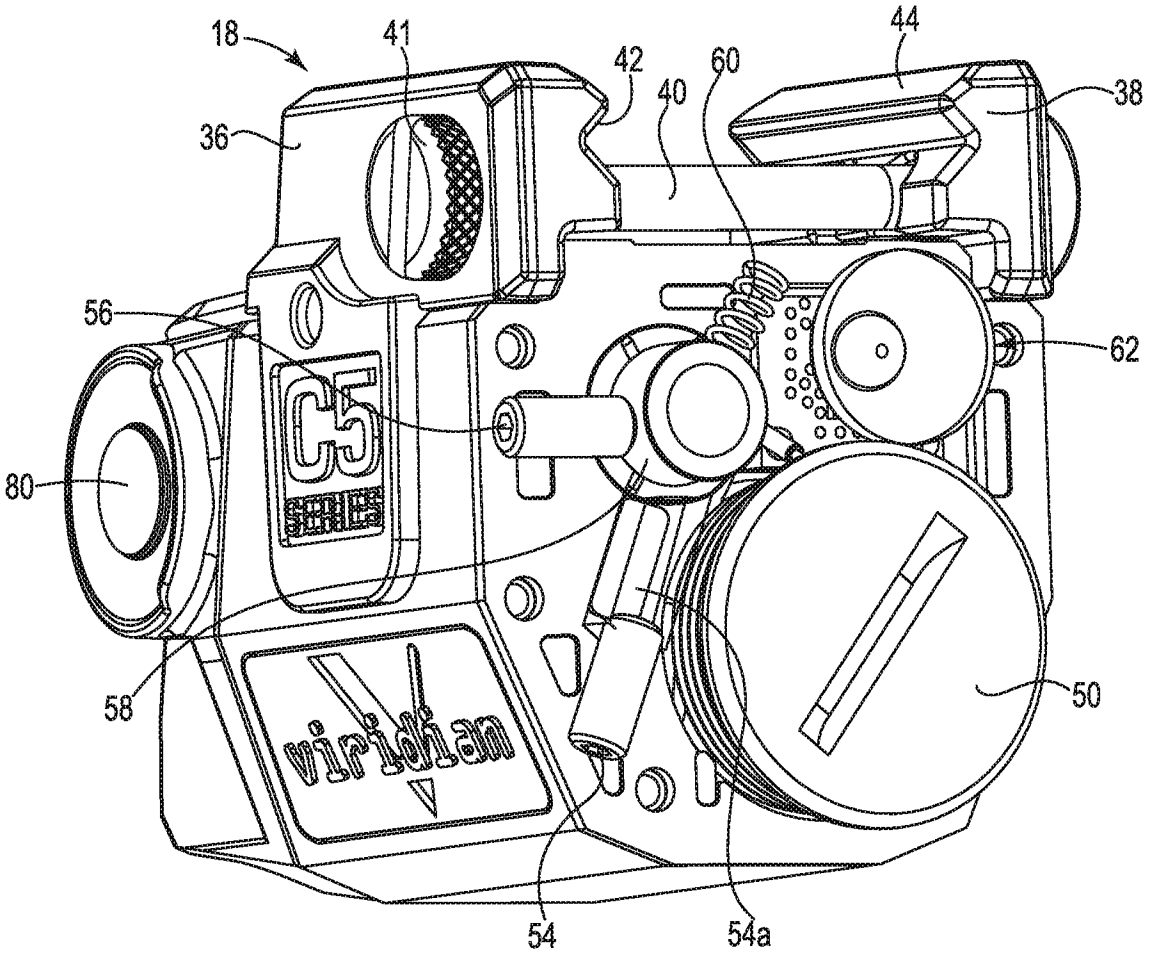
FIG. 5 is a perspective view of the green laser gun sight of FIG. 4, with a front plate removed to illustrate internal components.

FIG. 5 is similar to FIG. 4, except that the front cover 52 has been removed to better illustrate internal components. A light assembly 62 is disposed in alignment with the portion 48 of the front cover 52 (FIG. 4). It can be seen that the elevation screw 54 and the windage screw 56 are arranged in opposition to a spring 60 and thus can be used to alter a position of a laser collimating lens 58 as the force applied to the laser collimating lens 58 by the spring 60 includes a component aligned with (in opposition to) the elevation screw 54 as well as a component that is aligned with (in opposition to) the windage screw 56. An elevation screw spacer 54*a* extends between the elevation screw 54 and the laser collimating lens 58. In some embodiments, the laser collimating lens 58 may rest on a ribbed or otherwise textured surface to reduce friction.

An individual can adjust the aim of the laser beam emitted by the green laser sighting device 18 by turning the elevation screw 54 and/or the windage screw 56. As a result of turning the elevation screw 54 and/or the windage screw 56, the laser collimating lens 58 may slide radially or perpendicularly with respect to the green laser module 34. In some embodiments, the elevation screw 54 and the windage screw 56 may be configured to permit the laser collimating lens 58 to pivot relative to the green laser module 34. In some embodiments, the laser collimating lens 58 may be stationary, and the elevation screw 54 and/or the windage screw 56 may be used to alter the position of an additional lens or other optical component (not illustrated) in order to fine tune aiming of the green laser module 34.

Figure 6:
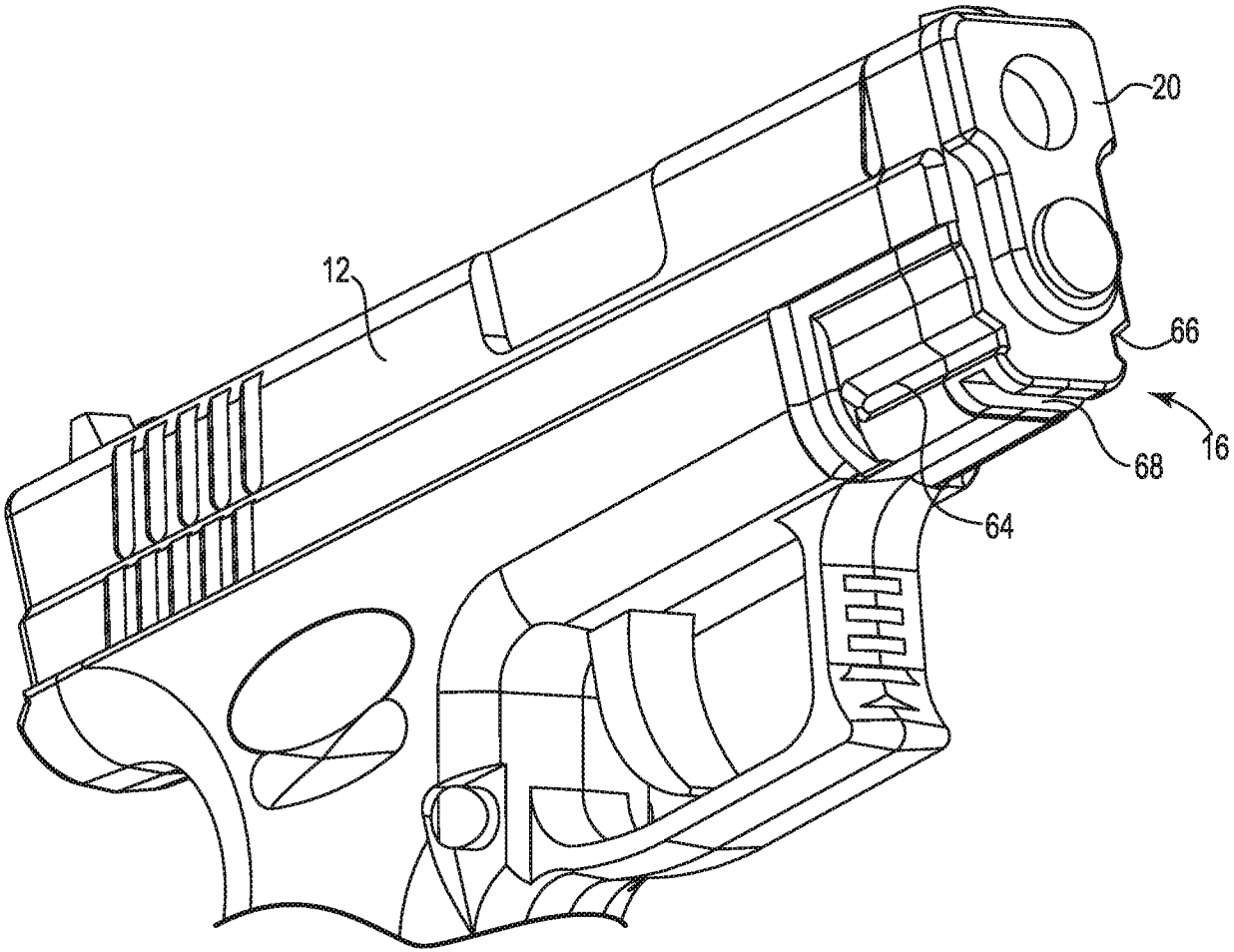
FIG. 6 is a perspective view of a portion of the handgun of FIG. 1.
Figure 7:
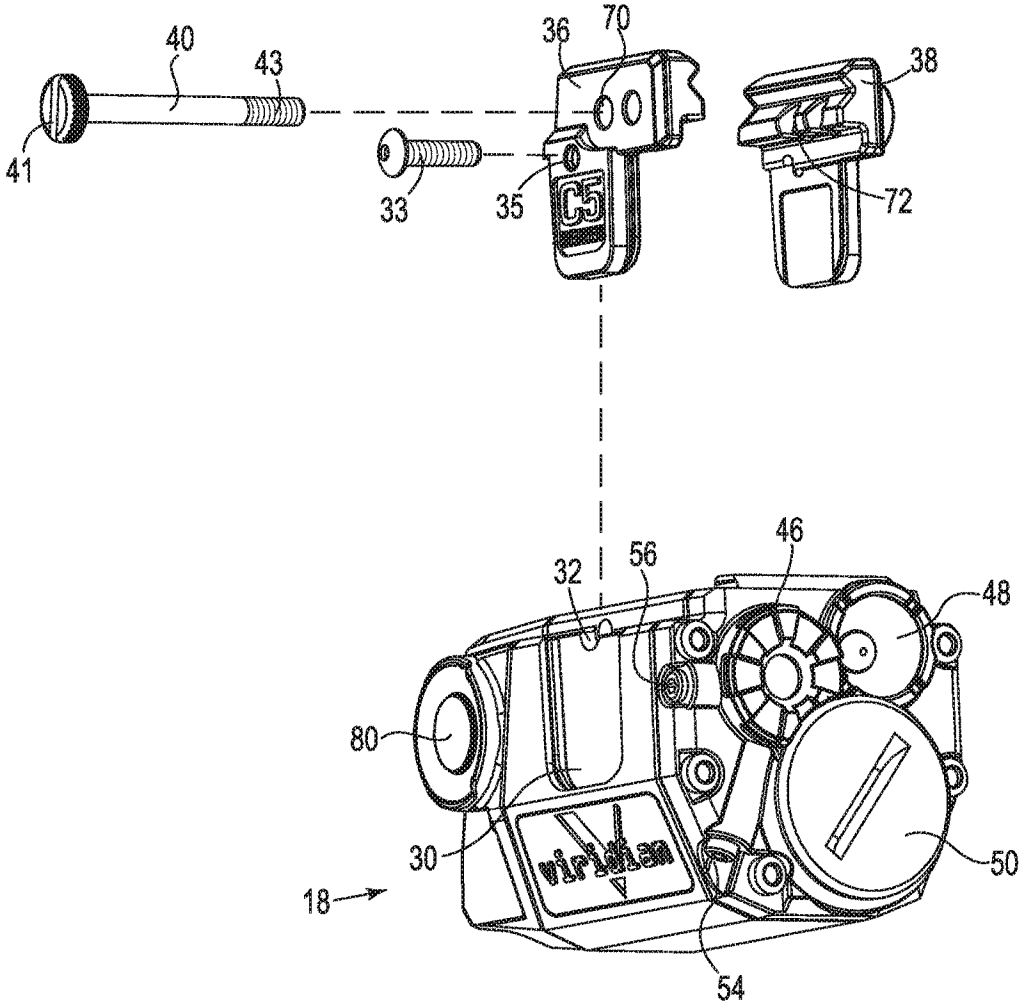
FIG. 7 is an exploded perspective view illustrating attachment of the green laser gun sight to the handgun.

FIGS. 6 and 7 illustrate in greater detail how the green laser gun sight 18 is attached to the handgun 10. FIG. 6 illustrates an enlarged end portion of the handgun 10 in which the rail system 16 may be seen as including a left (in the illustrated orientation) profile 64 and a corresponding right profile 66. FIG. 7 illustrates the green laser gun sight 18 in combination with the rail set 36 and the rail set 38. It will be appreciated that the mounting surface 42 of the rail set 36 is configured to fit into or otherwise interact with the left profile 64 of the rail system 16 and that the mounting surface 44 of the rail set 38 is configured to fit into or otherwise interact with the right profile 66 of the rail system 16. The left profile 64 and/or the right profile 66 may be configured to provide a key and lock arrangement between the rail sets 36 and 38 and the rail system 16 such that when the rail sets 36 and 38 are held together via the cross pin 40, the green laser gun sight 18 is held in place on the handgun 10.

In some embodiments, the rail system 16 also includes a horizontal cross slot 68. In some embodiments, as illustrated, the rail set 36 and the rail set 38 may include, respectively, mounting apertures 70 and 72 that permit the cross pin 40 to extend through the rail set 36 and the rail set 38. In some embodiments, the horizontal cross slot 68 is sized and positioned to accommodate the cross pin 40 and thereby prevent or at least substantially prevent lateral movement of the laser sighting device 18 relative to the handgun 10. In some embodiments, each of the rail sets 36 and 38 may include several different mounting apertures to accommodate particular handguns 10 having different positions for the horizontal cross slot 68.

In some embodiments, the rail sets 36 and 38 may include an aperture 35 (only one visible in FIG. 7) that is configured to accommodate a threaded rod or screw 33. The screw 33 may extend through the aperture 35 and thread into the aperture 32 formed in the housing 22 at or near the top of the groove 30. In some embodiments, instead of a screw 33, a pin may extend through the apertures 35 to secure the first and second rail sets 36, 38 to the green laser gun sight 18. In some embodiments, a single pin may extend through both rail sets 36, 38 and may form a frictional or compressive fit with the apertures 35 formed in each of the rail sets 36, 38.

It will be appreciated, therefore, that the green laser gun sight 18 may be attached to a variety of different handguns 10 without requiring alteration of the housing 22. Rather, the rail sets 36 and 38 may be configured to have mounting surfaces 42 and 44, respectively, that are configured to interact with the particular rail system 16 of a particular handgun 10.

The green laser gun sight 18 described with respect to FIGS. 1 through 7 may be considered in some cases as being designed for use with smaller handguns such as compact and subcompact handguns. FIGS. 8 through 10 illustrate a green laser gun sight 82 that shares many features with the green laser gun sight 18, but in some cases may be considered as being designed for use with larger guns such as full size handguns, rifles, shotguns and the like.

The green laser gun sight 82 includes a portion 84 that is configured to accommodate the green laser module 34. In some embodiments, the portion 84 may include a glass plate that permits the green laser light to pass through. The green laser gun sight 82 also includes a visible light module 86. In some embodiments, as illustrated, the visible light module 86 may be configured to provide substantially more visible light than that provided by the visible light module 62 (FIG. 5) and may extend outward relative to the portion 84. In some embodiments, the visible light module 86 may be considered as being positioned in front of a battery aperture formed within the green laser gun sight 82. In some embodiments, the visible light module 86 may be user-removable in order to permit battery installation and/or replacement. In some embodiments, the green laser gun sight 82 includes an elevation screw 88 and a windage screw 90 that can be used to adjust the aim of the green laser module by moving a laser collimation lens (as discussed previously with respect to the green laser gun sight 18).

The green laser gun sight 82 includes a first rail set 92 and a second rail set 94 that may be attached to the green laser gun sight 82 in a manner similar to that described previously with respect to the green laser gun sight 18. In some embodiments, a screw 96 attaches the first rail set 92 to the green laser gun sight 82, while a similar screw (not visible) attaches the second rail 94 to the opposing side of the green laser gun sight 82. In some embodiments, as illustrated, a pair of cross pins 98 secure the first rail set 92 to the second rail set 94 and thus secure the green laser gun sight 82 to a gun rail system. In some embodiments, it will be appreciated that larger guns have longer rail systems 102 and thus can accommodate more than one cross pin 98. In some embodiments, the green laser gun sight 82 may be physically larger and longer than, for example, the green laser gun sight 18 and thus may benefit from using more than one cross pin 98.

In some embodiments, the green laser gun sight 82 includes one or more switches 100 that can be used, for example, to program the green laser gun sight 82, to turn the green laser module 34 on or off, to turn the visible light module 86 on or off, to vary a pulse rate for the green laser module 34 and/or to vary a strobe rate for the visible light module. In some embodiments, there are a pair of switches 100, with one switch 100 arranged on each side of the green laser gun sight 82. In some embodiments, as illustrated for example in FIG. 9, the green laser gun sight 82 may not include the switch 100.

FIG. 9 is a rear perspective view of a green laser gun sight 104 secured to a long rail system 102. In some embodiments, the green laser gun sight 104, however, does not include the switch 100. Instead, the green laser gun sight 104 includes a rotary switch 106 and a lead 108 that extends to a remote switch (not illustrated). In some embodiments, the rotary switch 106 may be used to select a particular lighting program, i.e., solid or strobing visible light, solid or pulsing green laser, and the like, while the remote switch may be used to turn either the visible light module 86 and/or the green laser module 34 on or off.

As an illustrative but non-limiting example, the settings "A", "B", "C" and "D" may each be used to designate a particular function such as constant laser only, constant light only, or constant laser with constant light. In some embodiments, each of these functions may be momentary only. In some embodiments, on or more of the aforementioned settings may be used to designate independent activation between the two separate buttons 112 and 114 (discussed below with respect to FIG. 10). In some embodiments, the settings "1", "2", "3" and "4" may be used in a similar manner. In some embodiments, the setting labeled "P" may be used for a program setting that allows the user to change settings according to their preferences, such as the pulse rate for the laser and/or the strobe rate for the visible light. For example, one of the buttons 112 and 114 may be used to increase the laser pulse rate while the other of the buttons 112 and 114 may be used to decrease the laser pulse rate.

FIG. 10 is a schematic illustration of a remote switch 110 that includes a first switch button 112 and a second switch button 114. In some embodiments, the first switch 112 and the second switch button 114 may be individually pressed to turn the green laser gun sight 104 on or off. In some embodiments, the first switch 112 and the second switch 114 may be pressed together and/or in combination with rotating the rotary switch 106 to select between different program modes. The remote switch 110 may be located at any convenient location along the gun. In some embodiments, the remote switch 110 may be placed at a location proximate where the user holds the rifle or shotgun with their non-trigger hand, such as at or near the magazine. In some embodiments, the remote switch 110 may be mechanically or adhesively secured to the gun.

FIGS. 11 through 14 provide various views of a holster that is configured to accommodate a handgun 10 to which a green laser gun sight 18 has been attached. In some embodiments, the holster described herein is configured to interact with the green laser gun sight 18 to releasably secure the handgun 10 within the holster without engaging the trigger guard 14.

Figure 11:
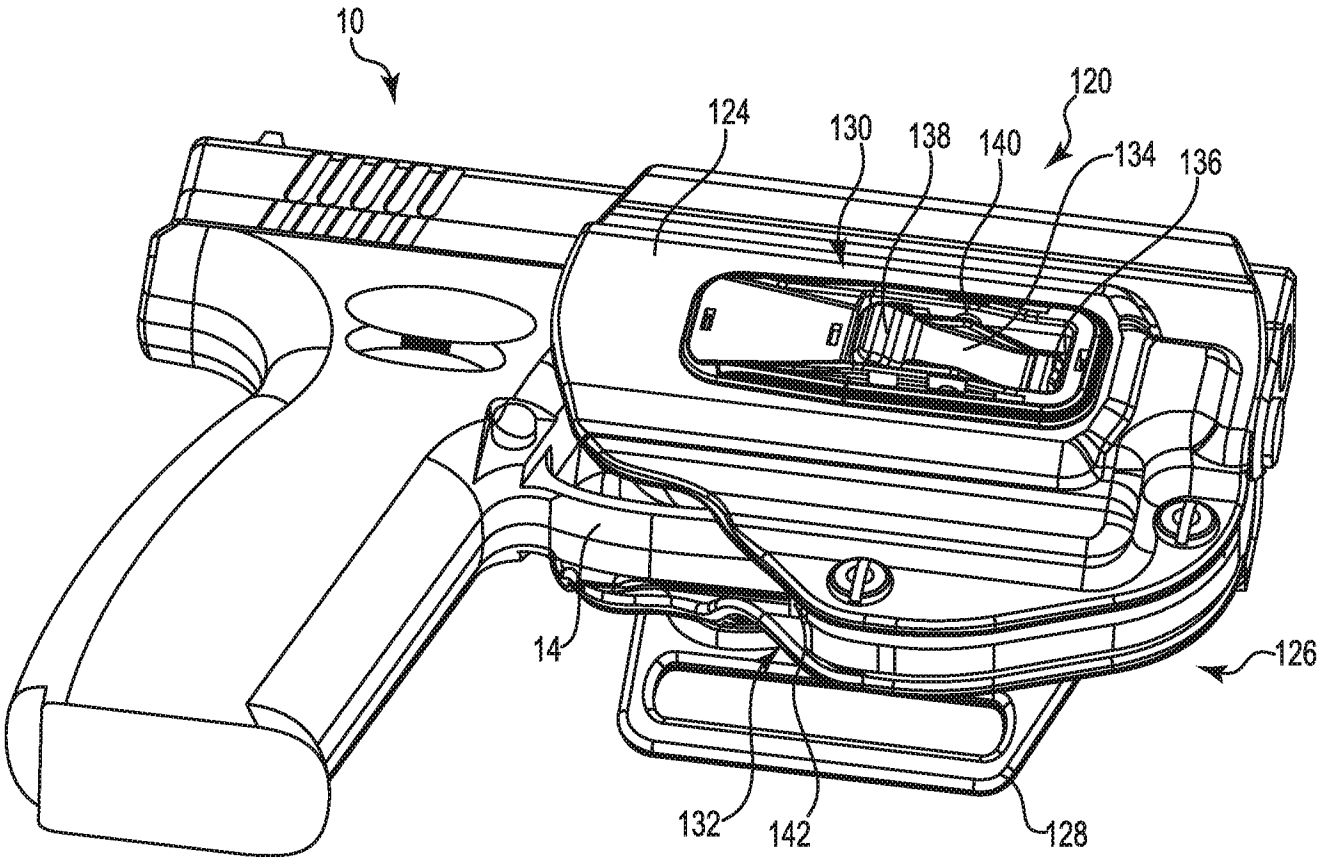
FIG. 11 is a perspective view of the handgun and green laser gun sight of FIG. 1 disposed within a holster.
Figure 12:
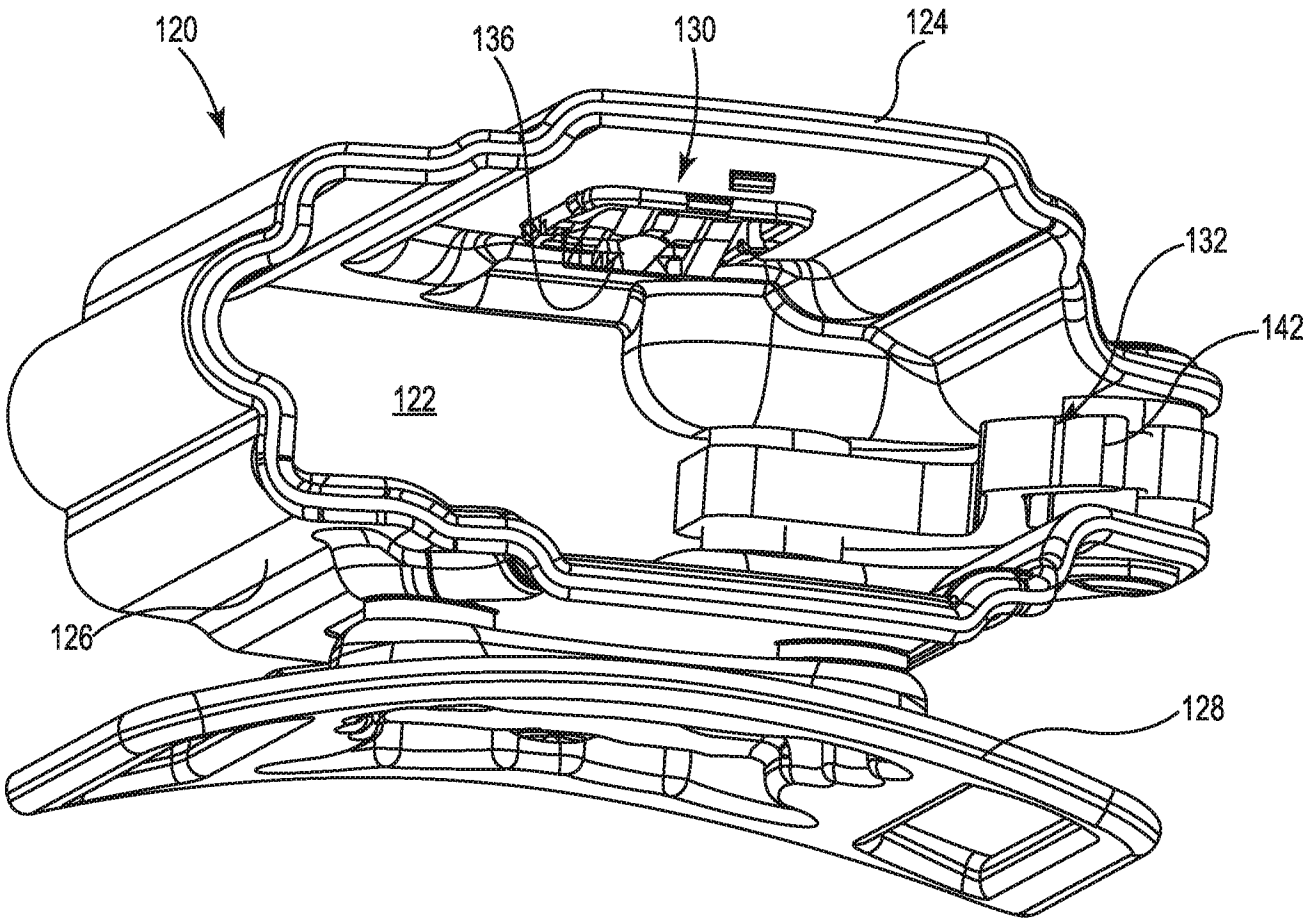
FIG. 12 is an upper perspective view of the holster of FIG. 11.
Figure 13:
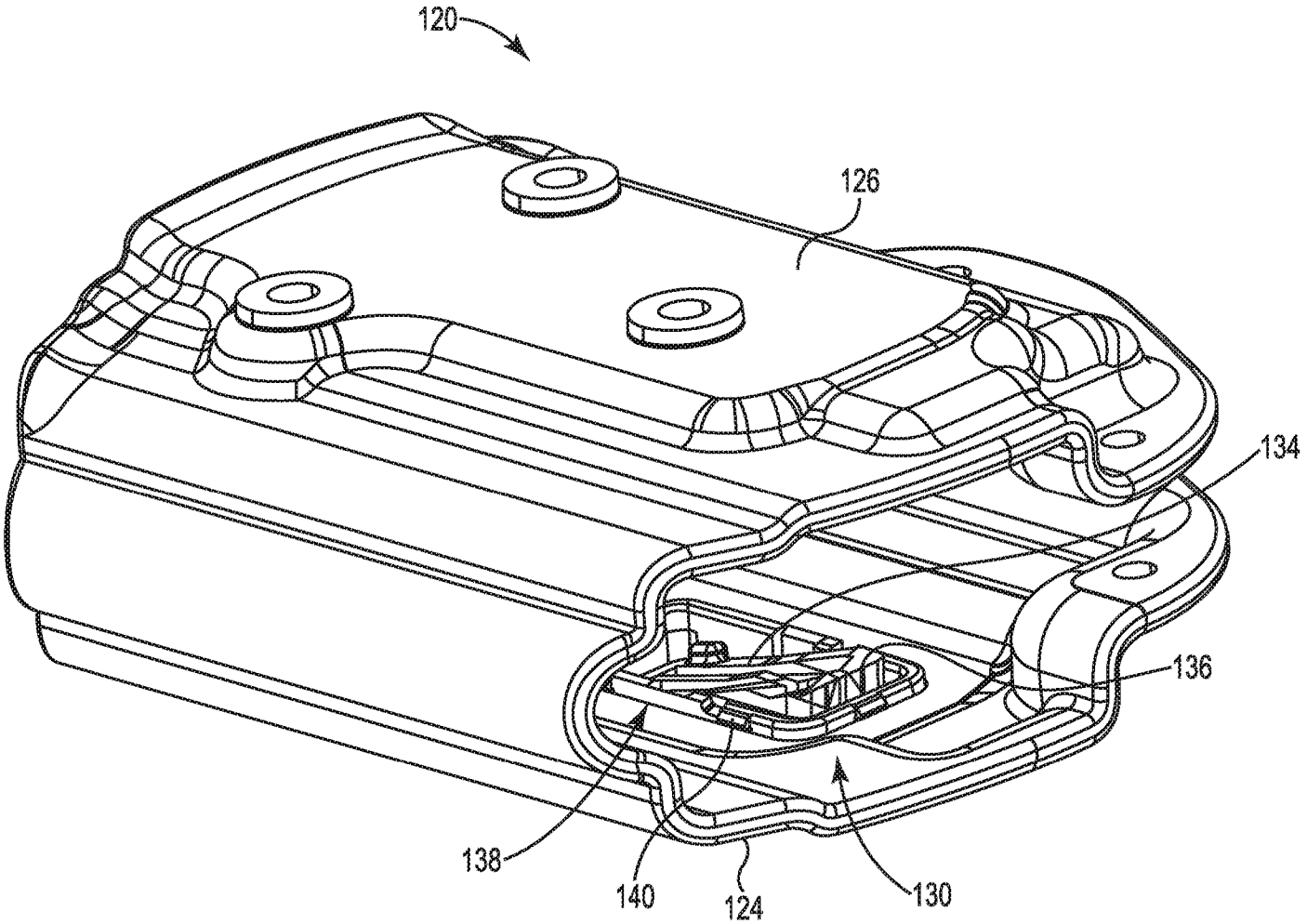
FIG. 13 is a lower perspective view of the holster of FIG. 11.

FIG. 11 is a perspective view of the handgun 10 disposed within a holster 120. FIG. 12 provides a view down into the holster 120 while FIG. 13 provides a lower perspective view. As seen in FIGS. 11-13, the holster 120 includes a pocket 122 that is formed between an outer panel 124 and an inner panel 126. In this, inner and outer may be considered as being relative to a user who has the holster 120 secured to their belt. The inner panel 126 is closest to a securement portion 128 that is configured to be secured to a user's belt.

In some embodiments, the outer panel 124 and the inner panel 126 may be distinct portions that are screwed, bolted, riveted or otherwise secured together. In some embodiments, as illustrated, the outer panel 124 and the inner panel 126 may instead be outer and inner portions, respectively, of a unitary structure. In some embodiments, the outer panel 124 and the inner panel 126 are molded as a unitary structure. The holster 120 may be formed of any suitable material. In some embodiments, the holster 120 is largely molded from a relatively rigid polymer such as KYDEX® or a similar material.

The holster 120 includes a primary retention device 130 and a secondary retention device 132. In some embodiments, the primary retention device 130 is configured to releasably engage with an external component of the green laser gun sight 18. In some embodiments, as illustrated, the primary retention device 130 includes a moveable lever 134 that includes an engagement portion 136, a finger button portion 138 and an intervening pivot point 140. In some embodiments, the moveable lever 134 is movable between an engagement position in which the engagement portion 136 interacts with a portion of the green laser gun sight 18 and a disengagement position in which the engagement portion 136 is moved out of engagement with the green laser gun sight 18. In some embodiments, the moveable lever 134 is biased into the engagement portion by a spring or similarly resilient element (not illustrated). In some embodiments, the primary retention device 130 is configured such that a user may easily draw the handgun 10 from the holster 120 by depressing the finger portion with their finger to move the primary retention device 130 to a disengagement position and wherein the primary retention device 130 is positioned relative to the pocket 122 such that the gun 10 may be withdrawn from the holster 122 with the user's finger proximate a switch 80 (FIG. 4) on the green laser gun sight 18.

In some embodiments, the secondary retention device 132 includes a resilient member 142 that forms a frictional fit with the housing 22 of the green laser gun sight 18. It will be appreciated that the secondary retention device 132 is configured to resist accidental removal of the gun 10 from the holster 120 but permits removal of the gun 10 from the holster 120 when the finger portion 138 is depressed and the gun 10 is withdrawn.

Figure 14:
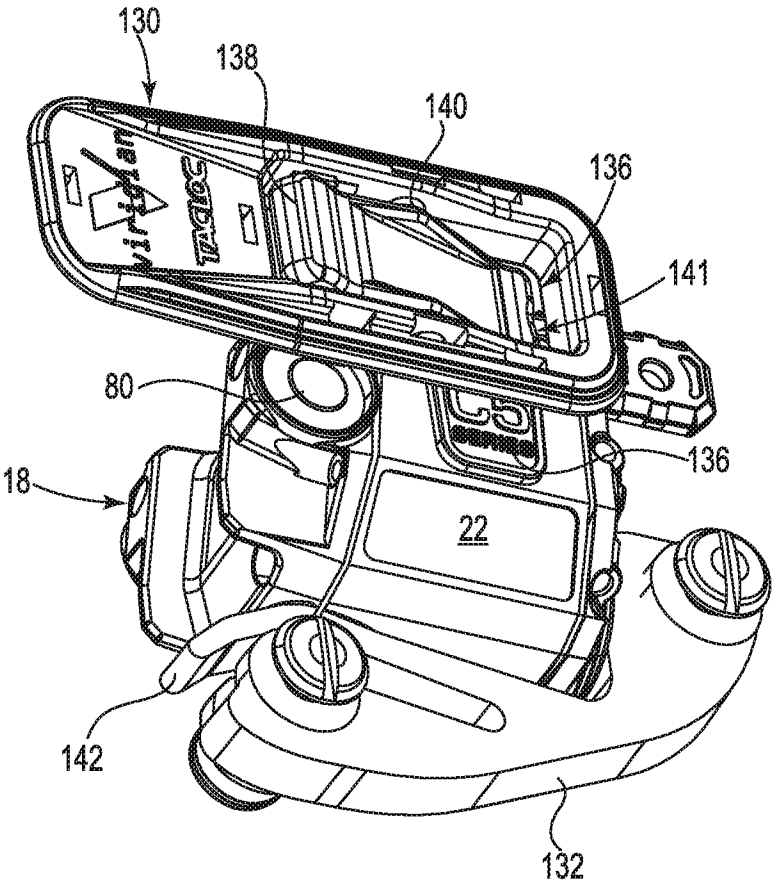
FIG. 14 is a partially cutaway perspective view of the holster of FIG. 11.
Figure 15:
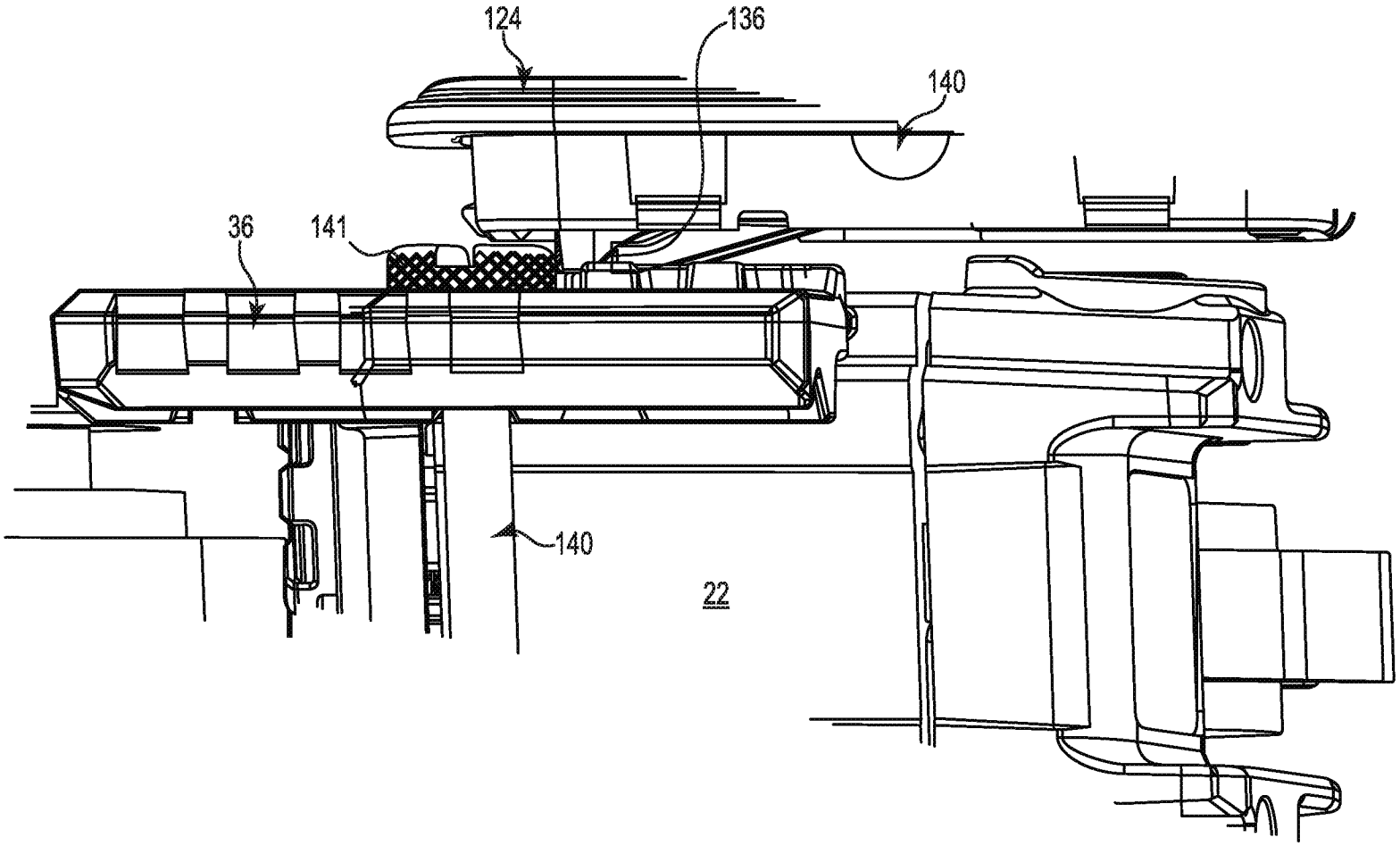
FIG. 15 is a view of a portion of the holster of FIG. 11, showing the primary retention feature engaging a component of the green laser gun sight.

FIGS. 14 and 15 illustrate how the primary retention device 130 interacts with the green laser gun sight 18. In particular, the primary retention device 130 interacts with a component of the green laser gun sight 18. In some embodiments, the engagement portion 136 of the primary retention device 130 engages with the head 141 of the cross pin 140. By comparing FIG. 14 with, for example, FIG. 4, it will be appreciated that the engagement portion 136 is positioned to oppose movement of the head 141 of the cross pin 140 and thus prevent withdrawal of the green laser gun sight 18 and the gun 10 to which the green laser gun sight 18 is attached. FIG. 15 also illustrates the relative position of the head 141 and the engagement portion 136 of the primary retention device 130 when the gun 10 is secured within the holster 120. It can be seen that the engagement portion 136 blocks movement of the head 141 when in an engagement position but permits movement when the user depresses the finger portion 138 and thus pivots the engagement portion 136 out of the way of the head 141.

Figure 16:
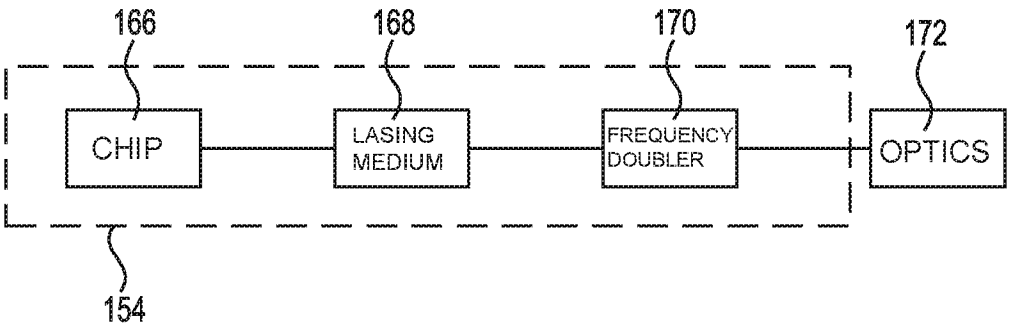
FIG. 16 is a schematic view of a green laser module used in the green laser gun sight of FIG. 1.

FIG. 16 is a schematic illustration of a green laser module 154 that may be considered as representative of the green laser module 34 previously discussed. The green laser module 154 is configured to produce coherent energy in the green (490-570 nm) range of a visible spectrum. Laser module components include a semiconductor chip 166 that emits radiation when receiving battery power, a lasing medium or crystal 168 provided for light amplification at the fundamental frequency corresponding to a wavelength of 1064 nm and a frequency doubler or crystal 170 for converting the energy to the desired wavelength of 532 nm. In some embodiments, beam collimating optics 172 are positioned to receive the light emitted by the frequency doubler or crystal 170. In some embodiments, the beam collimating optics 172 include the collimating lens 58 discussed previously. In some embodiments, the green laser module 154 may incorporate an infrared blocking filter.

Figure 17:
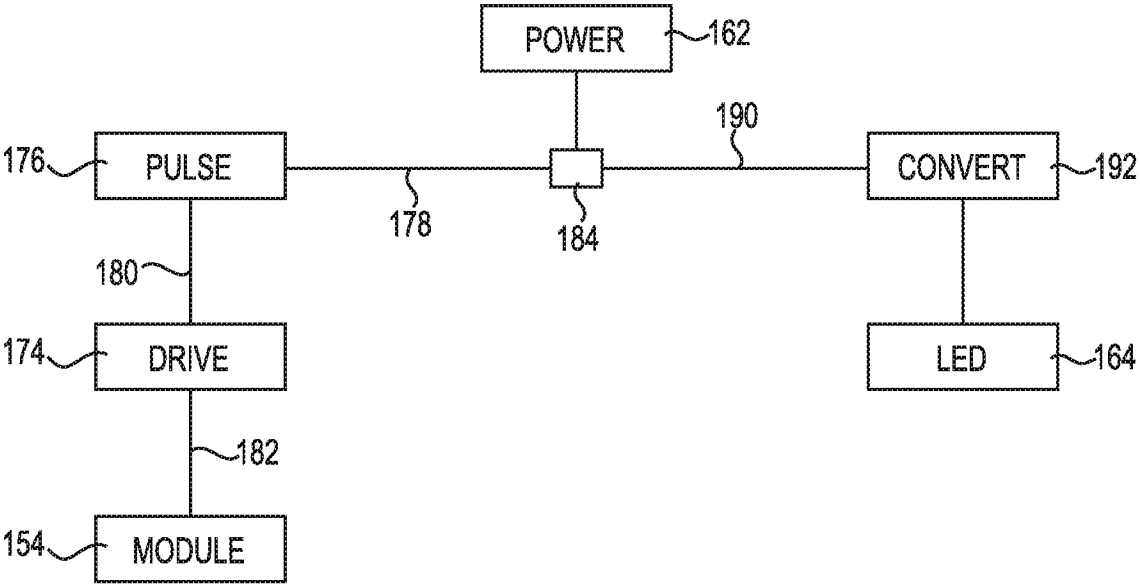
FIG. 17 is a simplified schematic view of electrical circuitry in the green laser gun sight of FIG. 1.

FIG. 17 provides a simplified schematic view of electrical circuitry in the green laser gun sight 18. In some embodiments, a printed circuit board 174 may be separated from the green laser module 154. A printed circuit board 176 that incorporates a microprocessor for a variety of functions including providing battery power to the printed circuit board 174 pulsed at a variety of predetermined pulsing frequencies, and interrupting power to the laser drive circuit after a predetermined time of laser operation with no user input, to prevent overheating and prolong battery life. A flexible or pliant conductor 178 electrically couples the battery 162 to the pulsing circuit 176, a conductor 180 couples the pulsing circuit 176 to the laser drive circuit 174, and a conductor 182 couples the laser drive circuit 174 to the laser module 154. A switch 184 is coupled to the pulsing circuit 176 and is operable to select one of several desired pulsing frequencies. In one version, the predetermined frequencies are 5 Hz, 7 Hz, and 10 Hz.

The pulsed input to laser drive circuit 174 causes the drive circuit 174 to generate a laser beam at substantially the same pulsing frequency, so that users visually perceive the beam as pulsed. Moreover, at the relatively low pulsing frequencies involved, the separate pulsing frequencies are readily visually distinguishable from one another. Consequently, in a situation in which sighting beams from several different firearms may be directed towards the same target, for example in certain law enforcement or military operations, the different pulsing rates allow each user to distinguish his or her sighting beam from the others.

More generally, the pulsing circuit 176 can be configured to provide power to the laser drive circuit 174 at several distinct pulsing frequencies, and further to provide power at several different pulsing circuit duty cycles, each associated with a different one of the pulsing frequencies. In each case, the laser drive circuit 174 provides power to the laser module according to a duty cycle controlled by its corresponding pulsing circuit duty cycle.

In some embodiments, the operator selects the desired pulsing frequency by operating the switch 184 to cycle through five distinct modes: continuous wave, pulse frequency number 1, pulse frequency number 2, pulse frequency number 3, and off. The switch 184 also is operable to control the light source 164. With further reference to FIG. 9, a conductor 190 couples the battery 162 to a voltage conversion circuit 192, which in turn is electrically coupled to the light source 164 by a conductor 194. Thus, the green laser module 154 and the light source 164 may be powered by the same power source.

Figure 18:
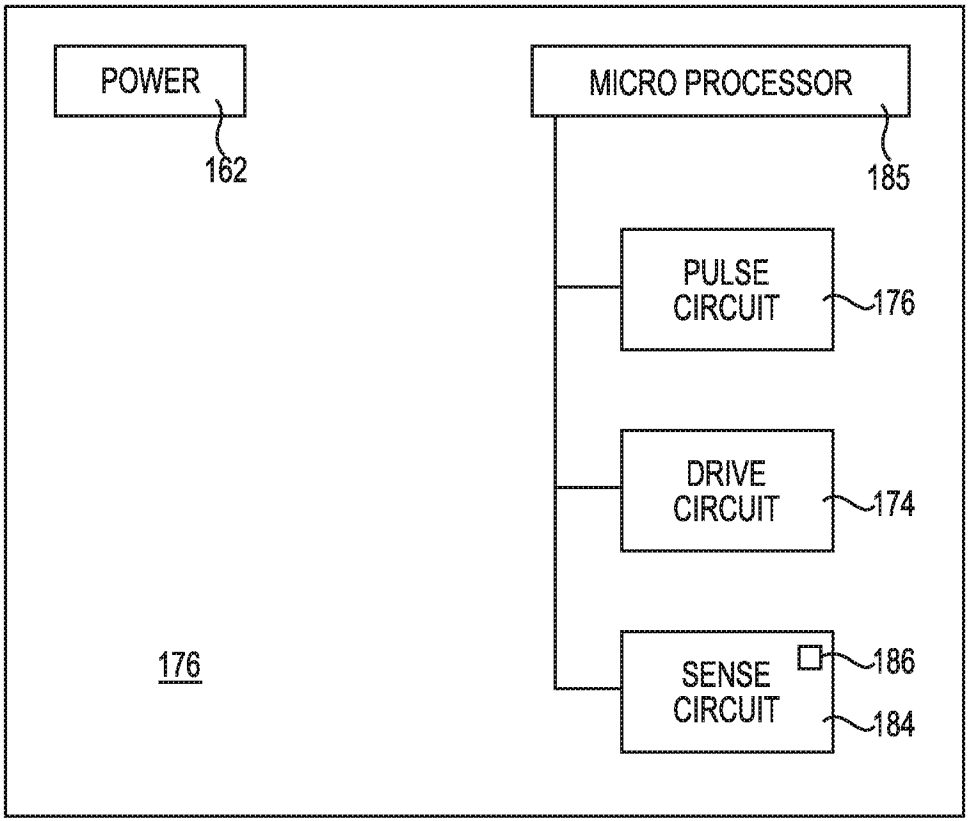
FIG. 18 is a simplified schematic view of electrical circuitry in the green laser gun sight of FIG. 1.

FIG. 18 provides a simplified schematic view of electrical circuitry in the green laser gun sight 18. While the laser gun sight 18 has been described as being a green laser gun sight, in some embodiments the laser gun sight 18 may instead be a red laser gun sight, a blue laser gun sight or an infrared laser gun sight. In some embodiments, the laser gun sight 18 is a green laser gun sight 18.

In some embodiments, the printed circuit board 176 may include a sensing circuit 184 that includes a Hall effect sensor 186. In some embodiments, as will be described, the holster 120 may include one or more magnets that are sized to produce a magnetic field that can be detected by the Hall effect sensor 186. In some embodiments, one or more magnets may be placed in a soft holster such as a pocket gun holster. In some embodiments, one or more magnets may instead be disposed on or in a flat surface such as the floor of a safe, a nightstand drawer, an automobile glove box, or the like. If the sensing circuit 184 detects a magnetic field of a particular strength, the microprocessor 185 decides that a gun 10 to which the green laser gun sight 18 has been mounted has been holstered. When the sensing circuit 184 no longer detects the magnetic field, the microprocessor 185 decides that the gun 10 has been drawn from the holster 120 or picked up from the aforementioned flat surface.

In some embodiments, the microprocessor 185 is configured to turn off the green laser gun sight 18 when detection of a magnetic field indicates that the gun 10 has been holstered or otherwise put away. In some embodiments, the microprocessor 185 is configured to turn on the green laser gun sight 18 when a lack of detection of a magnetic field indicates that the gun 10 has been drawn or picked up. In some embodiments, the microprocessor 185 is configured to turn on the green laser gun sight 18 upon removal from the holster 120 if the green laser gun sight 18 was turned on when holstered, and is configured to keep the green laser gun sight 18 turned off upon removal from the holster 120 if the green laser gun sight 18 was turned off when holstered.

In some embodiments, turning the green laser gun sight 18 on and off refers to completely shutting off the green laser gun sight 18 in order to conserve battery power. In some embodiments, this refers to turning portions of the aforementioned circuitry on or off. For example, turning off the green laser gun sight 18 may refer to stopping power to the laser module 154 and/or the LED module 164 to conserve battery power and/or prevent inadvertent detection of the gun 10 while other portions of the circuitry remain powered.

In some embodiments, the green laser gun sight 18 may be programmed using the one or more buttons 80 to automatically turn on the laser module 154 and/or the LED module 164 when the gun is drawn from the holster 120. In some embodiments, the green laser gun sight 18 may be programmed to automatically turn on the laser module 154 and/or the LED module 164 after a user programmable time delay should the user wish a short delay to, for example, better position the gun before providing a visual indication of the gun's presence.

Figure 19:
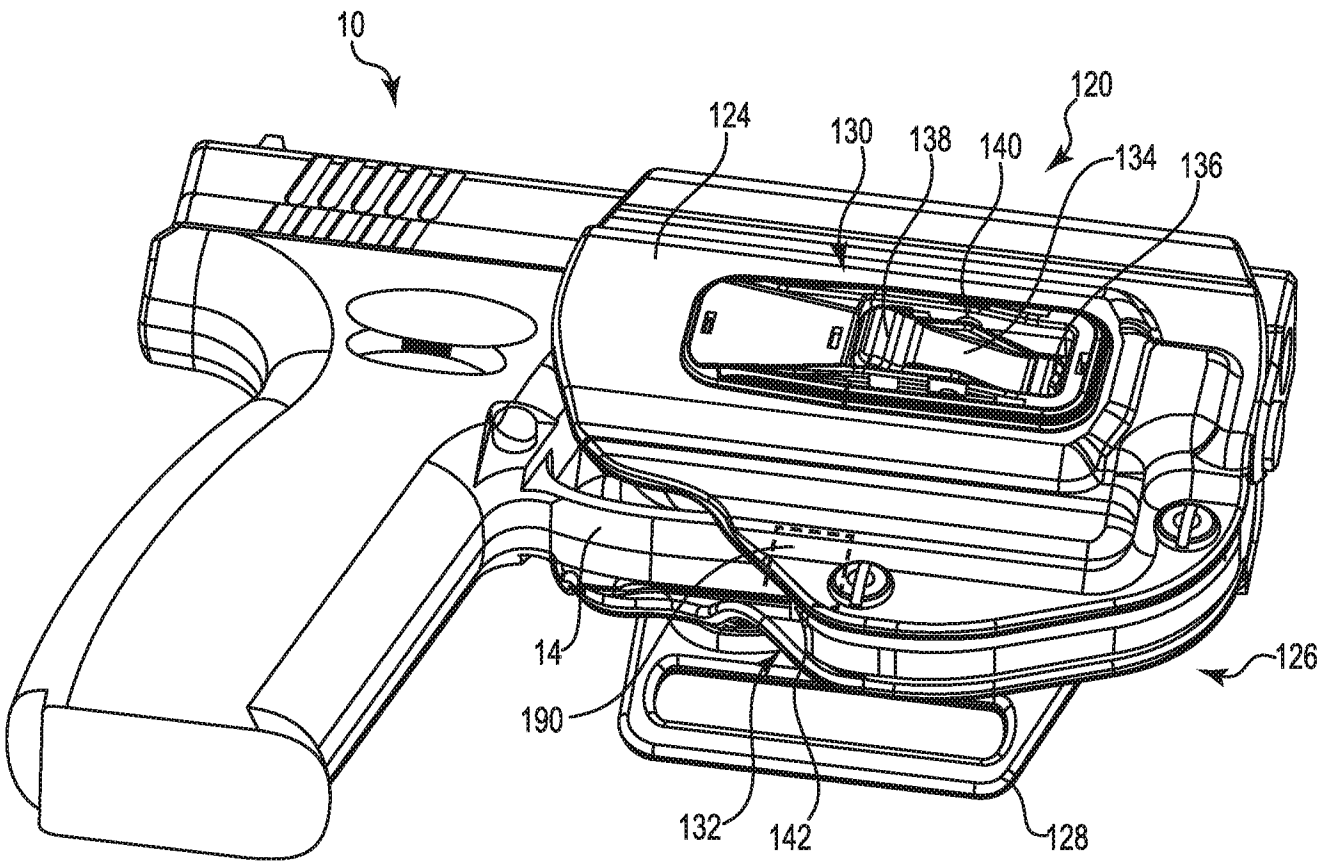
FIG. 19 is a perspective view of the handgun and green laser gun sight of FIG. 1 disposed within a holster.
Figure 20:
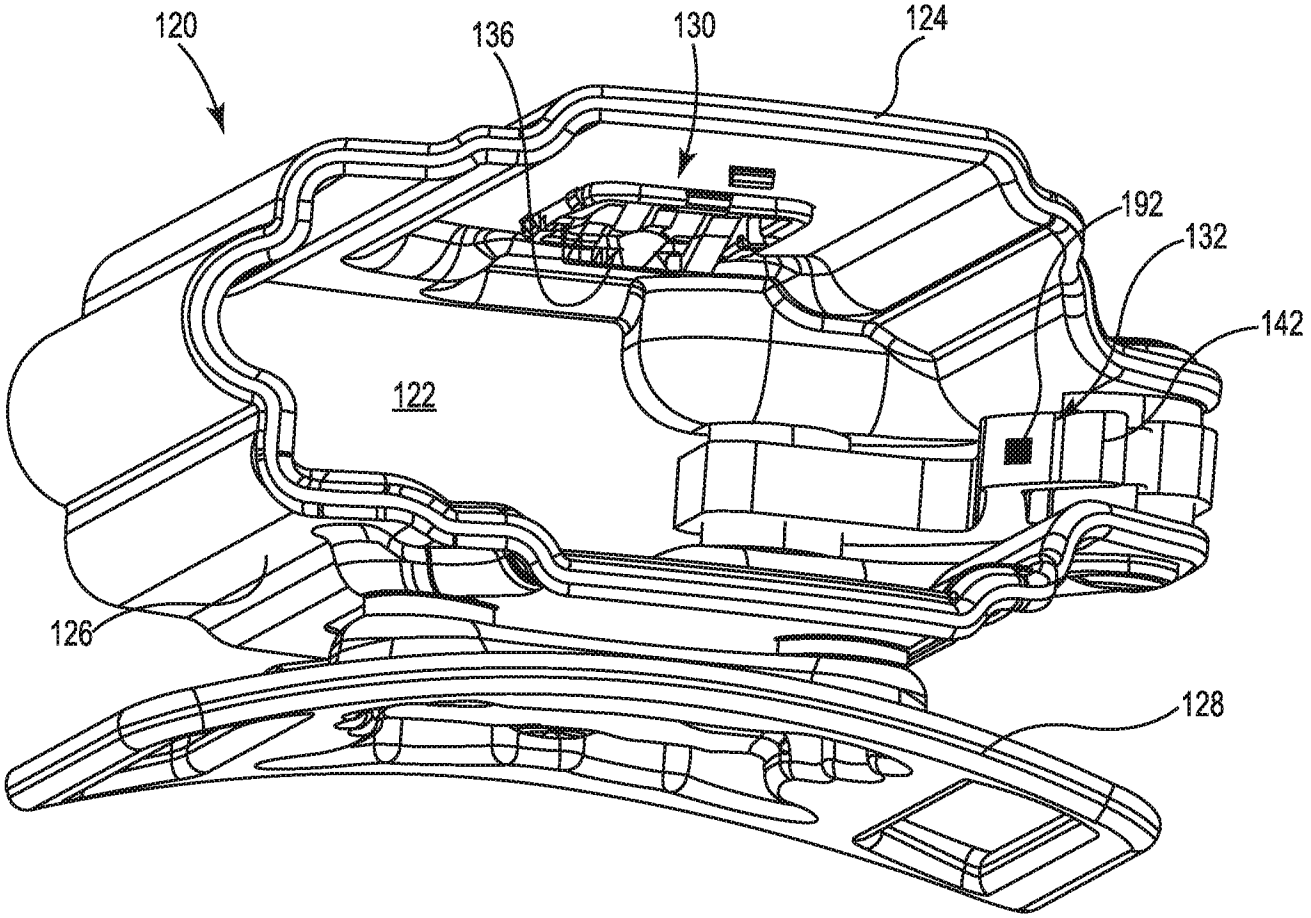
FIG. 20 is a partially cutaway perspective view of the holster of FIG. 19.
Figure 21:
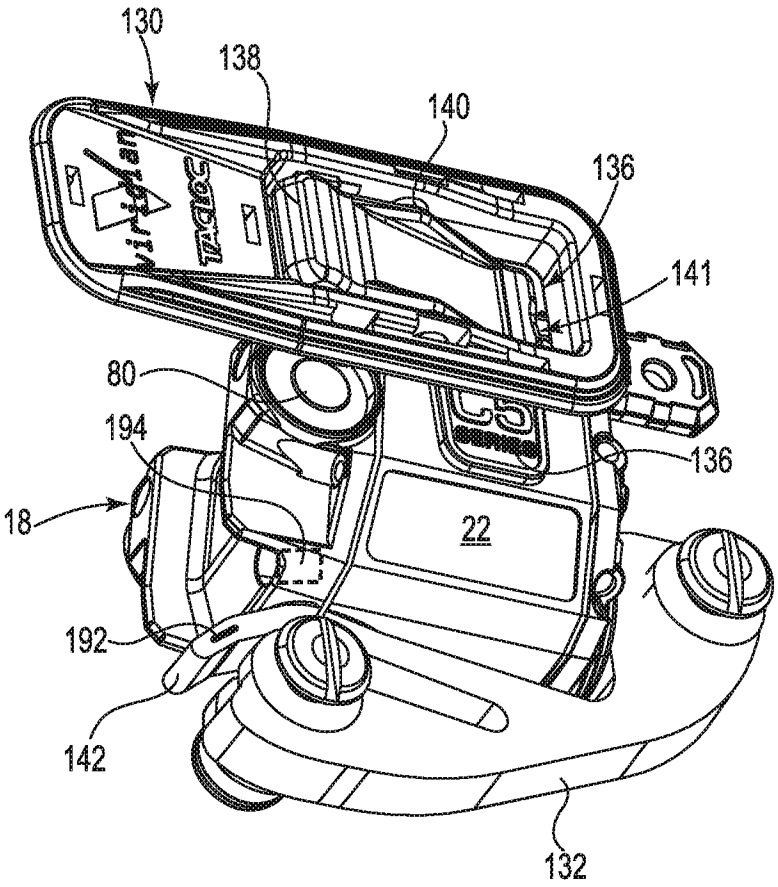
FIG. 21 is an upper perspective view of the holster of FIG. 19.

FIGS. 19-21 are similar to FIGS. 11, 12 and 14 described previously, but have been annotated to indicate an embodiment in which the green laser gun sight 18 and the holster 120 have been configured, in combination, to provide an instant-on feature. In FIG. 19, a region 190 has been indicated in phantom to show the relative position of the Hall effect sensor 186 in the sensing circuit 184 as well as a magnet disposed within the holster 120. FIG. 20 shows an embodiment in which a magnet 192 has been embedded in the resilient member 142. In some embodiments, the magnet 192 is a rare earth metal and may be adhesively fixed within a pocket formed in the resilient member 142. In FIG. 21, it can be seen that the magnet 192 is positioned relatively close to a region 194 of the green laser gun sight 18 that includes the sensing circuit 184 and the Hall effect sensor 186.

Various modifications and additions can be made to the exemplary embodiments discussed. For example, while the embodiments described above refer to particular features, the scope of this invention also includes embodiments having different combinations of features and embodiments that do not include all of the described features. Accordingly, the scope of the disclosure is intended to embrace all such alternatives, modifications, and variations as fall within the scope of the disclosure, together with all equivalents thereof.

What is claimed is:

1. An electronic accessory for a firearm comprising:

a housing including a right side, a left side, and an attachment mechanism for securing the electronic accessory to the firearm, the housing containing components of the electronic accessory, the components of the electronic accessory comprising:

an electronic component;

a sensor sensing a magnetic field;

a circuit board coupled to the electronic component and the sensor, the circuit board controlling the electronic component and suspending power to the electronic component when the sensor senses a magnetic field above a threshold strength;

a first switch disposed on the right side of the housing, the first switch being operable to control the electronic component via the circuit board;

a second switch disposed on the left side of the housing, the second switch being operable to control the electronic component via the circuit board; and a power source coupled to the circuit board, the power source providing power to at least one of: the electronic component, the sensor and the circuit board.

2. The electronic accessory of claim 1, wherein the electronic component comprises a laser module.

3. The electronic accessory of claim 2, wherein the first switch is operable to turn on and off the laser module, and the second switch is operable to turn on and off the laser module.

4. The electronic accessory of claim 2, wherein the first switch is operable to vary a pulse rate of the laser module, and the second switch is operable to vary the pulse rate of the laser module.

5. The electronic accessory of claim 2, the laser module comprising at least one of: a green laser module, a red laser module, a blue laser module and an infrared laser module.

6. The electronic accessory of claim 5, the laser module being the green laser module, and the green laser module comprising:

a semiconductor chip emitting radiation;

a lasing medium receiving the emitted radiation from the semiconductor chip and emitting light having a wavelength between about 980 nm to 1140 nm in response to receiving the emitted radiation; and a frequency modulator receiving the emitted light and converting the received emitted light to light having a wavelength between about 490 nm to 570 nm in response to receiving the emitted light.

7. The electronic accessory of claim 6, the lasing medium and the frequency modulator being crystals.

8. The electronic accessory of claim 2, the laser module comprising an infrared blocking filter.

9. The electronic accessory of claim 1, wherein the electronic component comprises a visible light module.

10. The electronic accessory of claim 9, wherein the first switch is operable to turn on and off the visible light module, and the second switch is operable to turn on and off the visible light module.

11. The electronic accessory of claim 9, wherein the first switch is operable to vary a strobe rate of the visible light module, and the second switch is operable to vary the strobe rate of the visible light module.

12. The electronic accessory of claim 1, the housing acting as a heat sink for heat generated by at least one of: the electronic component, the circuit board, and the power source.

13. The electronic accessory of claim 1, the sensor comprising a Hall-effect sensor.

* * * * *